United States Patent [19]

Shah

[11] 4,152,039

[45] May 1, 1979

[54] NON-DECOUPLING ELECTRICAL CONNECTOR

[75] Inventor: Bipin J. Shah, Melrose Park, Ill.

[73] Assignee: Akzona Incorporated, Asheville, N.C.

[21] Appl. No.: 844,331

[22] Filed: Oct. 21, 1977

[51] Int. Cl.[2] ..... H01R 13/54

[52] U.S. Cl. ..... 339/89 M; 285/81; 339/DIG. 2

[58] Field of Search ..... 339/89 R, 89 C, 89 M, 339/90 AU, DIG. 2; 285/86, 88, 317, 81

[56] References Cited

U.S. PATENT DOCUMENTS

| | | | |
|---|---|---|---|
| 1,325,468 | 12/1919 | Foster | 285/88 |
| 1,615,595 | 1/1927 | O'Connor | 285/88 |
| 3,601,764 | 8/1971 | Cameron | 339/89 M |
| 3,901,574 | 8/1975 | Paullus et al. | 339/90 R |

FOREIGN PATENT DOCUMENTS

| | | | |
|---|---|---|---|
| 2227655 | 11/1974 | France | 339/DIG. 2 |

*Primary Examiner*—Roy Lake

*Assistant Examiner*—E. F. Desmond

*Attorney, Agent, or Firm*—Francis W. Young; David M. Carter

[57] ABSTRACT

There is provided a cylindrical connector shell for receiving electrical contacts. The shell includes an annular recessed ring having at least one ratchet tooth projecting upwardly from the surface of the ring. One side of the tooth has a greater angle of inclination with respect to the surface of the ring than the other side. A coupling nut is received over the shell for engaging the shell with another body such as a mating connector shell. The coupling nut has at least one member projecting away from the inner surface of the nut for periodically engaging the ratchet tooth. The coupling nut turns easier in one direction than the other because of the angle differences of the sides of the ratchet teeth. At least one slot is further provided in front of the annular recessed ring for fitting the projecting member of the coupling nut into the recessed annular ring. The slot is deeper at one end than the other for snapping the coupling nut into the recess and securing the nut to the shell.

12 Claims, 8 Drawing Figures

NON-DECOUPLING ELECTRICAL CONNECTOR

BACKGROUND OF THE INVENTION

This invention relates to cylindrical electrical connectors. More particularly, it relates to an improved non-decoupling means for cylindrical electrical connectors. Many prior art electrical connectors used in an environment subject to vibrations, such as in aircraft engines, have a tendency to decouple. Some connectors are provided with safety wiring or lock wiring to prevent this inadvertent decoupling of the connector. The safety wiring is physically wrapped or tied about a portion of the plug shell and a portion of the receptacle shell to prevent them from becoming disconnected. It is somewhat inconvenient to manipulate this wiring and particularly difficult to install and inspect the condition of the wiring when a connector is located in a place which is not readily accessible.

Recently, non-decoupling features have been built into the connector itself. Examples of some of these non-decoupling features are disclosed and claimed in U.S. Pat. Nos. 3,971,614 and 4,030,798 assigned to AKZONA INCORPORATED, assignee of this Application.

The above patents disclose coupling nuts having a plurality of ratchet teeth projecting from the coupling nut in the same direction as the longitudinal axis of the connector. The ratchet teeth have sides of two different angles of inclination. A separate non-integral metal spring member is provided such that an arm of the spring member rides up the side of the ratchet tooth having the lower angle of inclination more easily than the other side so that the connector tends to stay coupled even during the vibration.

Some of the problems faced in the connectors disclosed in the above patents include the fact that the leaf spring quite often became bent when an inspector was uncoupling the connector. The finger of the leaf spring would jam against the steeper angled side of the ratchet tooth. This was particularly true of the connector disclosed in U.S. Pat. No. 3,971,614. The connector disclosed in U.S. Pat. No. 4,030,798 overcame this problem somewhat; however, with the advent of the plastic connector, it was found that a plastic spring would easily break because of compressive forces during rotation, particularly in the uncoupling direction. An alternative design was therefore needed to overcome the problems of the prior art.

OBJECTS OF THE INVENTION

It is therefore one object of the invention to provide an electrical connector having improved non-decoupling means.

It is another object of the invention to provide an electrical connector which may be made of plastic or other non-metal materials which will provide non-decoupling during vibration and which will not become easily damaged when the connector is uncoupled.

SUMMARY OF THE INVENTION

In accordance with one form of this invention, there is provided an electrical connector having a cylindrical shell adapted to receive at least one electrical contact. An annular ring integral with the shell has at least one ratchet tooth projecting upwardly from the surface of the ring. The tooth has at least a first and a second side, the first side being at a greater of inclination with respect to the surface of the ring than the second side. A coupling nut is adapted to be received over the shell. The coupling nut has at least one member projecting away from the inner surface of the nut for periodically engaging the tooth whereby the coupling nut will turn easier in one direction than the other direction about the shell.

BRIEF DESCRIPTION OF THE DRAWINGS

Reference will now be made to the accompanying drawings in which.

DESCRIPTION OF THE PREFERRED EMBODIMENT

Figure 1:
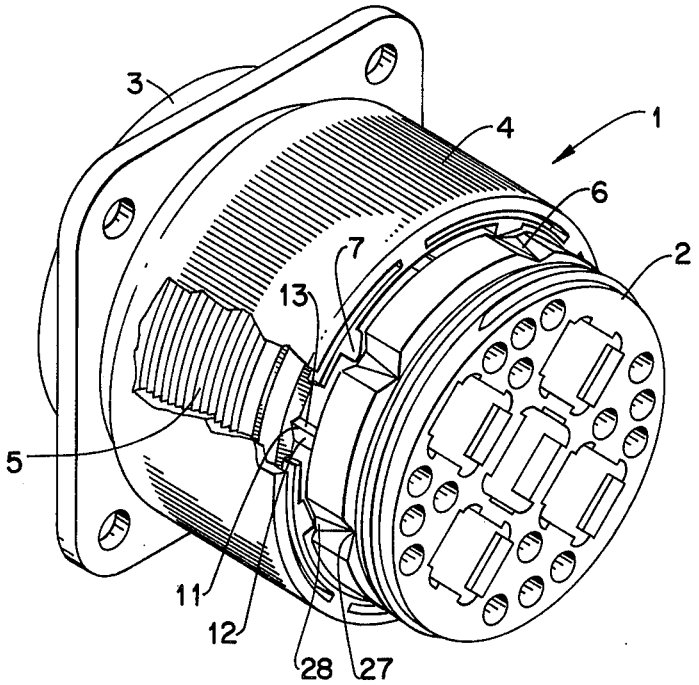
FIG. 1 is a partial perspective view of an electrical connector plug and receptacle and coupling nut showing an exemplary embodiment of the present invention.

Referring now more particularly to FIG. 1, there is provided electrical connector 1 having plug shell 2 and receptacle shell 3 tightly connected together by coupling nut 4. Coupling nut 4 screws onto threads 5 which lie on the outer cylindrical surface of receptacle shell 3. In the preferred embodiment the plug, receptacle and coupling nut are all molded with a thermoplastic material. Plug 2 includes a plurality of slots 6 for receiving a plurality of projections 7 which project down from the inner annular surface of coupling nut 4. The projections 7 pass through the slots 6 when the connector is assembled. This feature will be discussed in more detail below.

Figure 2:
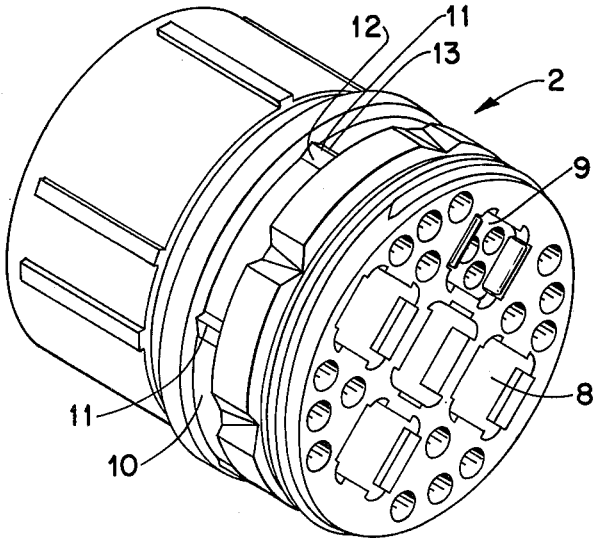
FIG. 2 is a perspective view of a connector shell showing portions of the present invention.

Referring now more particularly to FIG. 2, there is provided plug shell 2. Plug shell 2 includes a plurality of holes 8 which are adapted to receive removal module 9. The features of this aspect of the connector are disclosed and claimed in co-pending U.S. patent application Ser. No. 663,954, assigned to AKZONA INCORPORATED, assignee of the present invention.

Connector shell 2 includes recessed annular ring 10 having a plurality of ratchet teeth 11 extending upwardly from the surface of the annular ring. Side 12 of the ratchet tooth has a lower angle of inclination with respect to the surface of annular ring 10 than corresponding side 13. This may be seen more clearly with reference to FIG. 3.

Figure 3:
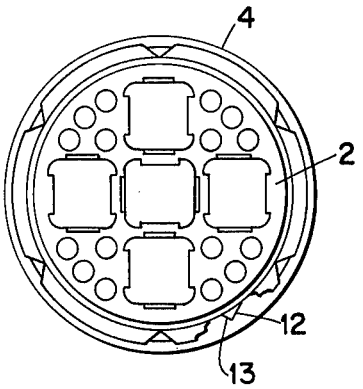
FIG. 3 is a partial end view of the connector shell and coupling nut shown in FIG. 1.

FIG. 3 shows an end view of the plug shell 2 and coupling nut 4. As can be seen from the broken-away portion, side 12 of ratchet tooth 11 has a lower angle of inclination than side 13.

As can be seen from FIG. 1, the projections 7 from coupling nut 4 rest in the annular recessed ring 10. The projections 7 cooperate with the ratchet teeth 11 to provide the non-decoupling feature as set forth herein.

This will be explained in more detail with reference to FIG. 6.

Figure 4:
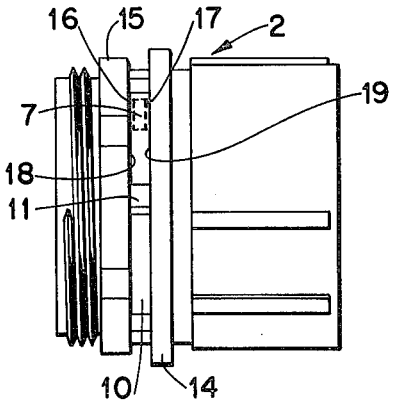
FIG. 4 is a side view of the connector shell shown in FIG. 2.

Referring now more particularly to FIG. 4, there is shown a side view of connector plug shell 2. Annular shoulder 14 extends beyond the sides of shell 2, and annular shoulder 15 also extends beyond the sides of the shell in order to retain the coupling nut onto the connector. The projections from the inside of the coupling nut ride in recessed ring 10, and as stated previously, cooperate with ratchet teeth 11 to prevent the decoupling of the connector during vibration. The sides 16 and 17 of projection 7 shown in phantom are substantially contiguous to the sides of 18 and 19 of annular shoulders 15 and 14. These shoulders help retain the coupling nut on plug shell 2. A metal retaining ring (not shown) may also be installed between side 16 of projection 7 and side 18 of annular shoulder 15 in order to assist in retaining the nut. The coupling nut itslef may be better understood in reference to FIGS. 5 and 8.

Figure 8:
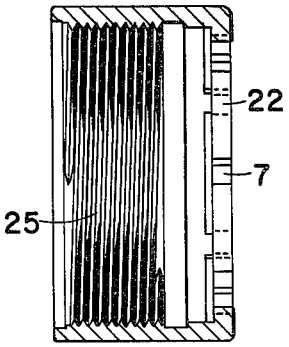
FIG. 8 is a cross-sectional view of the coupling nut.

As can be seen from FIG. 8, the coupling nut also includes a plurality of threads 25 which engage threads 5 of the receptacle 3 as shown in FIG. 1.

Figure 5:
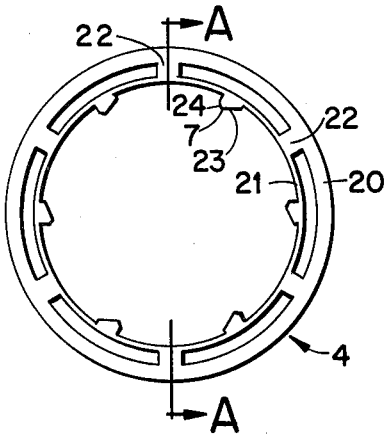
FIG. 5 is an end view of the coupling nut incorporating some of the features of this invention.

FIG. 5 shows an end view of coupling nut 4. Coupling nut 4 includes an outer annular portion 20 connected to a inner spring portion 21 by means of pillars 22. Spring 21 is a thin plastic ring and provides a spring force for projection 7. Spring 21 provides the dual functions of snapping the projection through variable depth slot 6, locking it into annular recess 10, and providing the spring force so that the projection easily rides up ramp 12 and making it more difficult to ride up ramp 13 so that the non-decoupling effect is achieved. As can be seen, the projections 7 include ramp 23 which has a lower angle of inclination than ramp 24. This further enhances the non-decoupling effect when the projections are cooperating with ratchet teeth 11. The non-decoupling feature of the invention is better illustrated in reference to FIG. 6.

Figure 6:
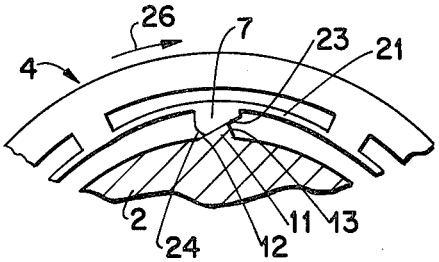
FIG. 6 is an enlarged view of a portion of the coupling nut and shell illustrating the engagement of a projecting member of the coupling nut and a ratchet tooth of the shell.

FIG. 6 shows an enlarged partial view of the coupling nut 4 and plug shell 2. Arrow 26 shows the direction of tightening of the coupling nut onto the shell; i.e., the coupling direction. Projection 7 has its low angle of inclination surface 23 engaging the low angle of inclination surface 12 of the ratchet tooth 11. During vibration tests which simulate environments such as aircraft engines, it has been shown that the coupling nut actually tightens on the shell rather than becoming loose as one might normally expect of a connector. As can be seen, if the coupling nut were to be turned in the other direction, that is, the uncoupling direction, the steep side 13 of the ratchet tooth would engage with the steep side 24 of the coupling nut. It has been shown that the uncoupling direction is a much more difficult direction to turn than the tightening direction. As can be seen, spring 21 is highly bowed during the engagement of the projection 7 and the ratchet tooth 11. This spring in this instance provides the force for the non-decoupling feature of the invention to be operative.

Figure 7:
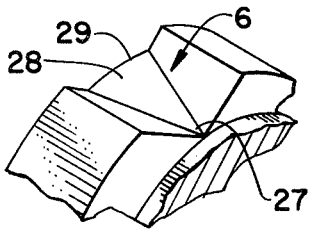
FIG. 7 is an enlarged view of a portion of the shell showing one of the slots for receiving the projection from the coupling nut during assembly.

Another feature of the invention relating to the use of the spring 21 and projection 7 cooperating with slots 6 may be better seen in reference to FIGS. 1 and 7.

FIG. 7 shows an enlarged view of a slot 6 shown in FIG. 1. The front surface area of slot 6 indicated as 27 is at a lower elevation with respect to the longitudinal axis of the connector shell then the rear area 28. Projection 7 is adapted to slip into the front 27 of slot 6 and then moved towards the rear area 28. As the coupling nut is moved toward the rear, the spring deflects because of the higher elevation is higher at the rear. When the projection 7 goes over the back boundary 29 of the slot, the spring snaps the projection into the recessed annular ring 10 of the shell. An audible snap sound is heard when this occurs. Thus, when one is assembling the connector he is assured that the coupling nut is in place due to this audible snap. Furthermore, since the spring force has pushed the projection down, the projection now rides against the side 18 of annular ring 15 and side 19 of annular ring 14 as shown in FIG. 4, locking the coupling nut into place on the shell. As stated previously, a retaining ring may also be used to assist in locking the nut onto the shell.

From the foregoing description of this embodiment of the invention, it is apparent that many modifications may be made therein. It will be understood that this embodiment of the invention is intended as an exemplification of the invention only, and the invention is not limited thereto. It is to be understood, therefore, that it is intended in the appended claims to cover all such modifications which fall in the true spirit and scope of this invention.

What is claimed is:

1. An electrical connector comprising a cylindrical shell adapted to receive at least one electrical contact; an annular ring integral with said shell, said ring having at least one ratchet tooth projecting upwardly from the surface of said ring; said tooth having first and second sides, said first side having a greater angle of inclination with respect to the surface of said ring than said second side; a coupling nut adapted to be received over said shell; a spring member connected to said coupling nut; a projecting member integral with and extending from said spring member for periodically engaging said tooth whereby said coupling nut will turn more easily in one direction than the other about said shell.

2. A connector as set forth in claim 1 wherein said connector is made of a plastic material.

3. A connector as set forth in claim 1 further including a plurality of ratchet teeth.

4. A connector as set forth in claim 1 further including a plurality of projection members.

5. A connector as set forth in claim 1 further including a second cylindrical shell, the other cylindrical shell being a plug and the second cylindrical shell being a receptacle; said plug and said receptacle shells being screwed together by said coupling nut.

6. A connector as set forth in claim 1 wherein said spring member is integral with said coupling nut.

7. A connector as set forth in claim 6 wherein said spring member is an annular spring; at least one pillar connecting said spring to said coupling nut.

8. A connector as set forth in claim 1 wherein said projecting member has at least two sides, one side having a slope of a different angle of inclination than the other side.

9. A connector as set forth in claim 1 wherein said annular ring is recessed in said shell, said annular ring being recessed between a pair of annular shoulders.

10. A connector as set forth in claim 9 further including a plurality of slots in one of said annular shoulders for allowing said projecting member of said coupling nut to be inserted therein during the assembly of said connector; said projecting member being snap fitted into said recessed annular ring.

11. A connector as set forth in claim 10 wherein one end of each of said slots being lower in elevation with respect to the longitudinal axis of said shell than the other end of said slots.

12. An electrical connector comprising:

a first and a second cylindrical shell adapted to receive a plurality of electrical contacts;

a recessed annular ring integral with said shell, said ring having a plurality of ratchet teeth projecting upwardly from the surface of said ring, said teeth having first and second sides, said first side having a greater angle of inclination with respect to the surface of said ring than said second side, said annular ring recessed between a pair of annular shoulders;

a coupling nut adapted to be received over said shell, said coupling nut having a plurality of projecting members extending away from the inner surface of said coupling nut for periodically engaging said plurality of said ratchet teeth so that said coupling nut will turn easier in one direction than in the other direction about said shell;

said coupling nut further including an annular spring member integral with said projecting member; said spring member further integral with the outer shell of said coupling nut; one of said annular shoulders of said shell having a plurality of slots therein for allowing said projecting members to be inserted into said recessed ring; the front of said slots being lower in elevation than the rear of said slots for snapping said projecting members into said recessed ring and securing of said coupling nut about one of said shells.

* * * * *